US007383802B2

(12) United States Patent
Ido et al.

(10) Patent No.: US 7,383,802 B2
(45) Date of Patent: Jun. 10, 2008

(54) VALVE TIMING ADJUSTING APPARATUS

(75) Inventors: Shinsuke Ido, Kariya (JP); Eiji Isobe, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 11/790,565

(22) Filed: Apr. 26, 2007

(65) Prior Publication Data

US 2007/0251478 A1 Nov. 1, 2007

(30) Foreign Application Priority Data

Apr. 27, 2006 (JP) ..... 2006-124256

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

2004/0187819 A1* 9/2004 Takenaka et al. ..... 123/90.17
2007/0012270 A1 1/2007 Hori et al.

FOREIGN PATENT DOCUMENTS

JP 2005-048706 2/2005

* cited by examiner

*Primary Examiner*—Zelalem Eshete
(74) *Attorney, Agent, or Firm*—Nixon & Vanderhye P.C.

(57) ABSTRACT

In a valve timing adjusting apparatus, an outer peripheral surface of each projection of an internal gear, which is received in a corresponding engaging hole of a guide rotator, may have reduced surface sections, which are radially inwardly reduced toward a radial center of the projection along a radial line of the internal gear that passes through the radial center of the projection to have a reduced radial size in comparison to a radial size of the rest of the outer peripheral surface of the projection. Alternatively, an inner peripheral surface of each engaging hole may have recessed surface sections, which are radially recessed from the rest of the inner peripheral surface of the engaging hole along a radial line of the guide rotator that passes through a center of the inner peripheral surface of the engaging hole.

9 Claims, 9 Drawing Sheets

VALVE TIMING ADJUSTING APPARATUS

CROSS REFERENCE TO RELATED APPLICATION

This application is based on and incorporates herein by reference Japanese Patent Application No. 2006-124256 filed on Apr. 27, 2006.

BACKGROUND OF THE INVENTION

1. Field of the Invention

The present invention relates to a valve timing adjusting apparatus of an internal combustion engine that adjusts valve timing of at least one of an intake valve and an exhaust valve, which is opened and closed by a camshaft with a torque transmitted from a crankshaft, according to a relative phase (hereinafter, referred to as an engine phase) between the crankshaft and the camshaft.

2. Description of Related Art

A previously known valve timing adjusting apparatus changes the engine phase through a planetary movement of a second gear, which is eccentric to and is meshed with a first gear that is synchronously rotated with a crankshaft or a camshaft. Therefore, a rotator, which is coaxial with the first gear and is engaged with the second gear, is rotated relative to the first gear in response to the planetary movement. Japanese Unexamined Patent Publication No. 2005-48706 discloses such a valve timing adjusting apparatus. According to this publication, multiple projections axially project from the second gear and are arranged one after another in a revolving direction of the second gear. Multiple engaging holes, which receive and engage the projections, respectively, are arranged one after another in a rotational direction of the rotator. When a torque is transmitted from the second gear to the rotator through engaged surfaces between the projections and the engaging holes, the rotator is rotated relative to the first gear.

In the valve timing adjusting apparatus disclosed in the above publication, an outer peripheral surface of each projection and an inner peripheral surface of each engaging hole are both cylindrical to implement smooth relative movement therebetween, so that frictional sticking of the projection against the inner peripheral surface of the engaging hole is advantageously limited. However, when the projection engages the inner peripheral surface of the engaging hole at or around a radial line of the second gear, which passes through a center of curvature of the cylindrical outer peripheral surface of the projection, an urging force of the projection, which urges the inner peripheral surface of the engaging hole in the radial direction of the rotator, is increased. This radial urging force does not contribute to the rotation of the rotator and disadvantageously increases a friction between the projection and the inner peripheral surface of the engaging hole, thereby possibly deteriorating a transmission efficiency of the torque. This kind of disadvantage also occurs in a case where the projection engages the inner peripheral surface of the engaging hole at or around a radial line of the rotator, which passes through a center of curvature of the cylindrical inner peripheral surface of the engaging hole.

SUMMARY OF THE INVENTION

The present invention addresses the above disadvantages. Thus, it is an objective of the present invention to provide a valve timing adjusting apparatus, which increases a transmission efficiency of a torque that changes an engine phase.

To achieve the objection of the present invention, there is provided a valve timing adjusting apparatus of an internal combustion engine, which controls valve timing of at least one of an intake valve and an exhaust valve that are opened and closed by a camshaft driven by a torque transmitted from a crankshaft at the engine. The valve timing adjusting apparatus includes a first gear, a second gear and a rotator. The first gear is rotated synchronously with one of the crankshaft and the camshaft of the engine. The second gear is eccentric to the first gear and is meshed with the first gear to make a planetary movement. The second gear includes a plurality of projections that are arranged one after another in a revolving direction of the second gear and axially project from the second gear. The rotator is coaxial with and is rotated relative to the first gear in response to the planetary movement of the second gear to change a relative phase between the crankshaft and the camshaft and thereby to change the valve timing of the at least one of the intake valve and the exhaust valve. The rotator includes a plurality of engaging holes, which are arranged one after another in a rotational direction of the rotator and loosely receive the plurality of projections, respectively, in such a manner that each of the plurality of projections is engageable with an inner peripheral surface of a corresponding one of the plurality of engaging holes to transmit a torque between the second gear and the rotator. An outer peripheral surface of each of the plurality of projections has at least one reduced surface section, which is radially inwardly reduced toward a radial center of the projection along a radial line of the second gear that passes through the radial center of the projection to have a reduced radial size in comparison to a radial size of the rest of the outer peripheral surface of the projection.

To achieve the objective of the present invention, there is also provided a valve timing adjusting apparatus of an internal combustion engine, which controls valve timing of at least one of an intake valve and an exhaust valve that are opened and closed by a camshaft driven by a torque transmitted from a crankshaft at the engine. The valve timing adjusting apparatus includes a first gear, a second gear and a rotator. The first gear is rotated synchronously with one of the crankshaft and the camshaft of the engine. The second gear is eccentric to the first gear and is meshed with the first gear to make a planetary movement. The second gear includes a plurality of projections that are arranged one after another in a revolving direction of the second gear and axially project from the second gear. The rotator is coaxial with and is rotated relative to the first gear in response to the planetary movement of the second gear to change a relative phase between the crankshaft and the camshaft and thereby to change the valve timing of the at least one of the intake valve and the exhaust valve. The rotator includes a plurality of engaging holes, which are arranged one after another in a rotational direction of the rotator and loosely receive the plurality of projections, respectively, in such a manner that each of the plurality of projections is engageable with an inner peripheral surface of a corresponding one of the plurality of engaging holes to transmit a torque between the second gear and the rotator. An inner peripheral surface of each of the plurality of engaging holes has at least one recessed surface section, which is radially recessed from the rest of the inner peripheral surface of a engaging hole along a radial line of the rotator that passes through a center of the inner peripheral surface of the engaging hole.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Figure 1:
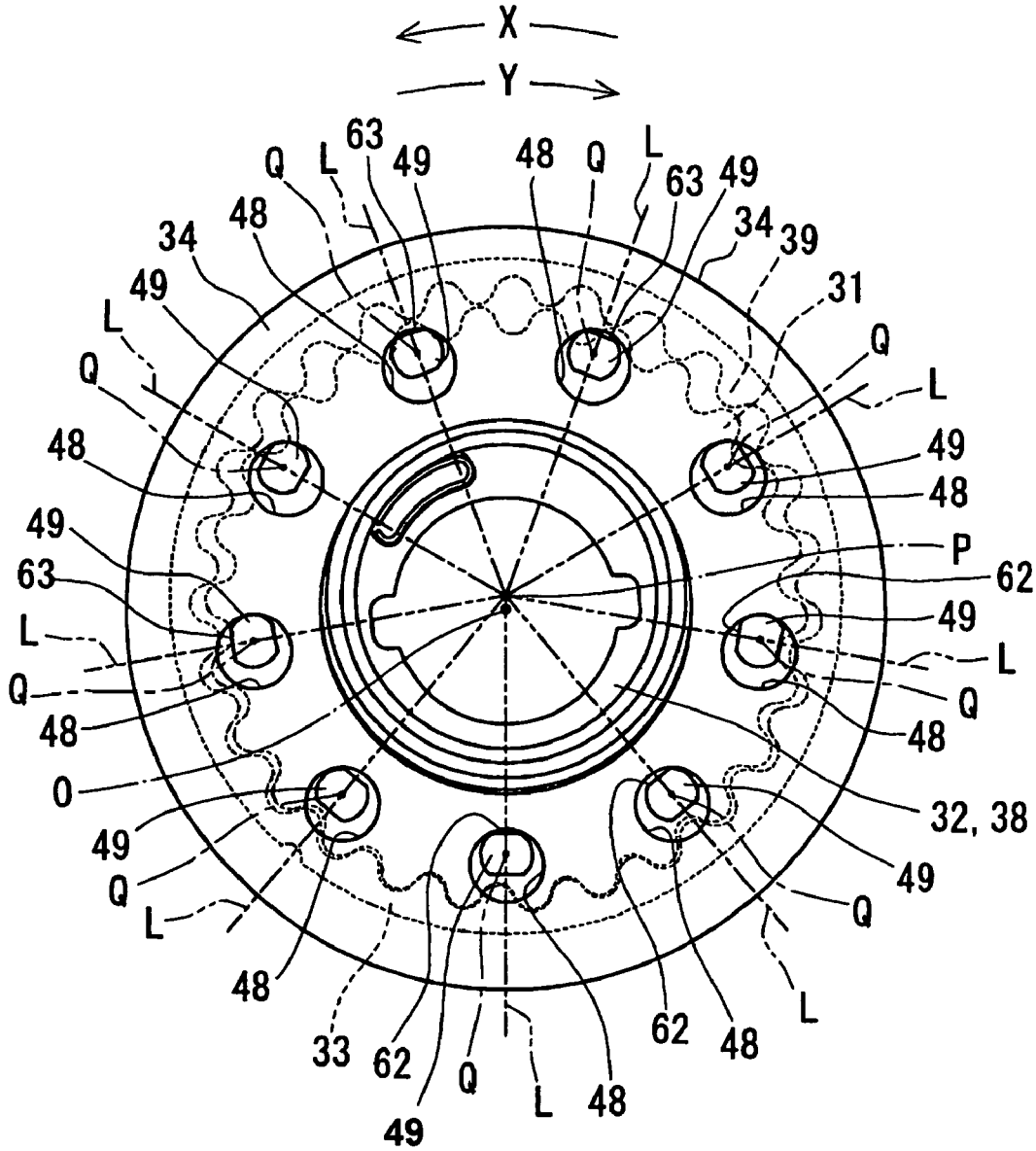
FIG. 1 is a cross sectional view taken along line I-I in FIG. 2, showing a characteristic structure according to a first embodiment of the invention.
Figure 2:
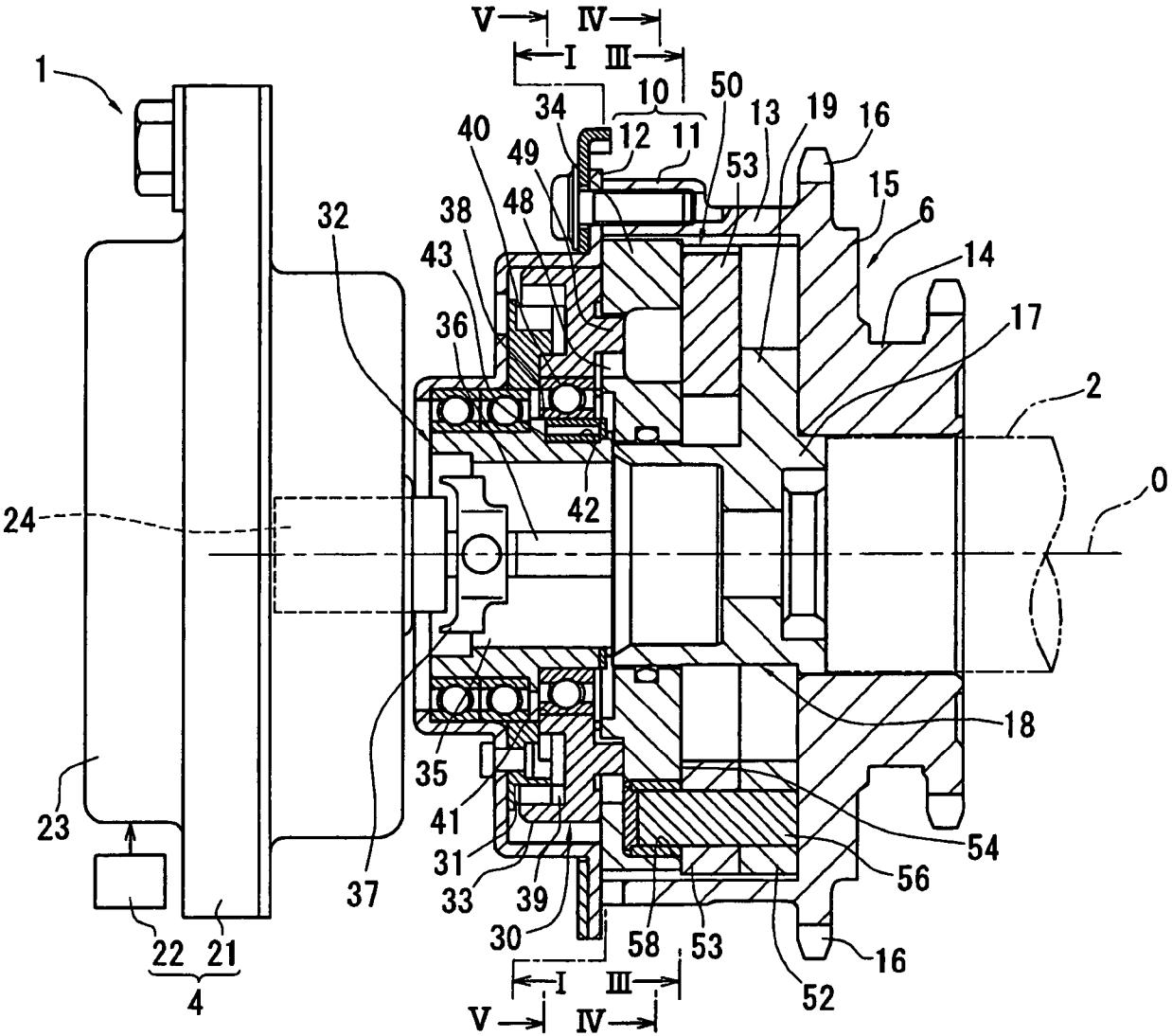
FIG. 2 is a cross sectional view taken along line II-II in FIG. 3, showing an entire schematic structure according to the first embodiment of the invention.

With reference to FIGS. 1 and 2, a valve timing adjusting apparatus 1 according to a first embodiment is provided in a transmission system, which transmits an engine torque from a crankshaft (not shown) of an internal combustion engine to a camshaft 2. The valve timing adjusting apparatus 1 adjusts valve timing of an intake valve(s) of the engine by changing a relative phase between the crankshaft and the camshaft 2. The valve timing adjusting apparatus 1 includes an electrical control system 4 and a phase change mechanism 6.

The electrical control system 4 includes an electric motor 21 and a power supply control circuit 22. The electric motor 21 is, for example, a brushless motor and includes a motor case 23 and a motor shaft 24. The motor case 23 is fixed to the engine through a stay (not shown). The motor shaft 24 is supported by the motor case 23 in a rotatable manner in both of a normal rotational direction and a reverse rotational direction. The power supply control circuit 22 includes a driver and a microcomputer. The microcomputer controls an operation of the driver. Furthermore, the power supply control circuit 22 is placed inside or outside of the motor case 23 and electrically connected to the electric motor 21. The power supply control circuit 22 controls supply of the electric current to a coil (not shown) of the electric motor 21 based on an operational state of the engine. Through this power supply control operation, the electric motor 21 forms a rotating magnetic filed around the motor shaft 24 to exert the rotational torque to the motor shaft 24 in the direction X or Y (see FIG. 5) in consistent with a direction of the rotating magnetic field. In the following description, a rotational torque, which is generated by the electric motor 21, will be referred to as a motor torque.

The phase change mechanism 6 includes a driving-side rotator 10, a driven-side rotator 18, a speed reducer unit 30 and a link unit 50.

Figure 3:
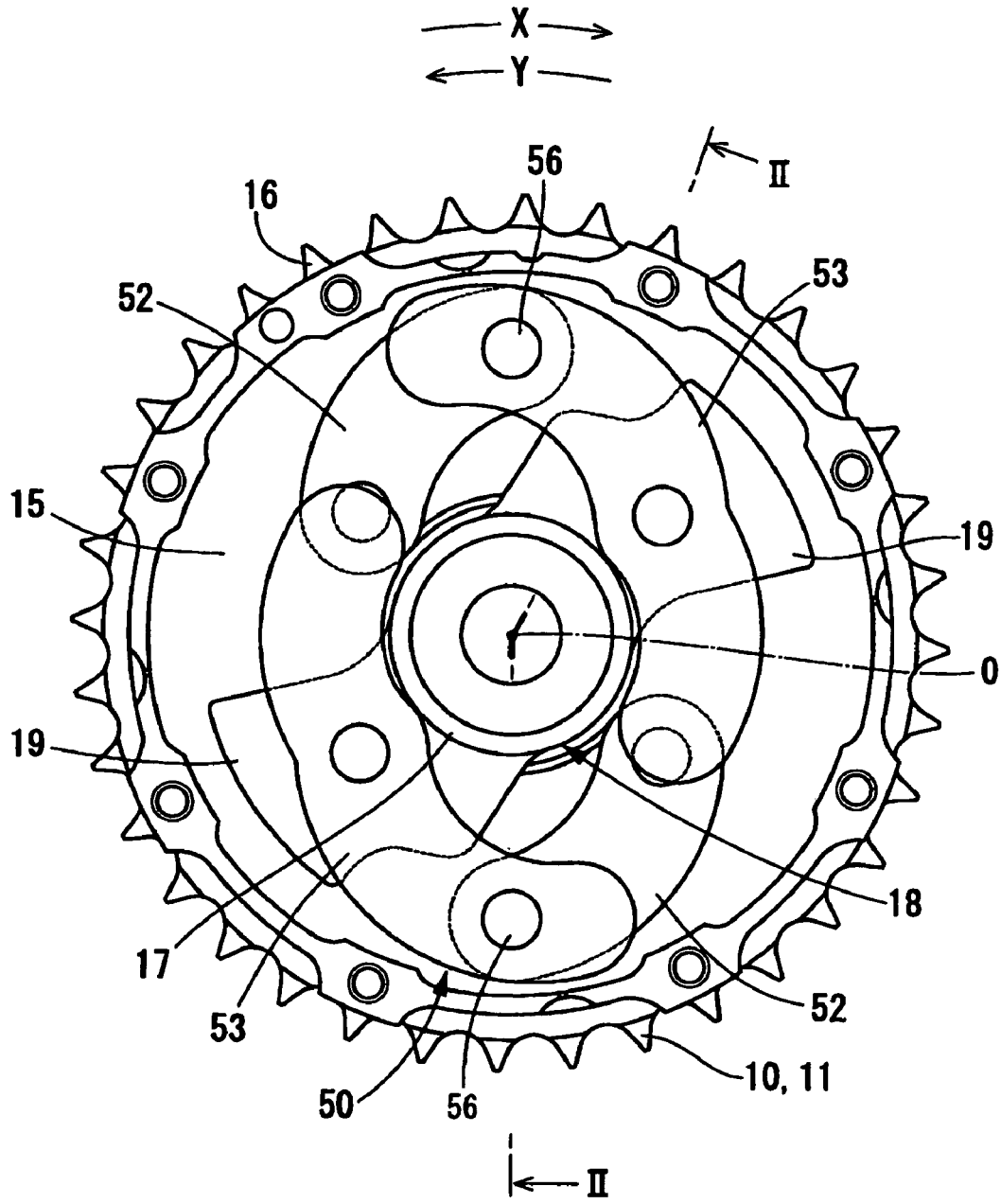
FIG. 3 is a cross sectional view taken along line III-III in FIG. 2.
Figure 4:
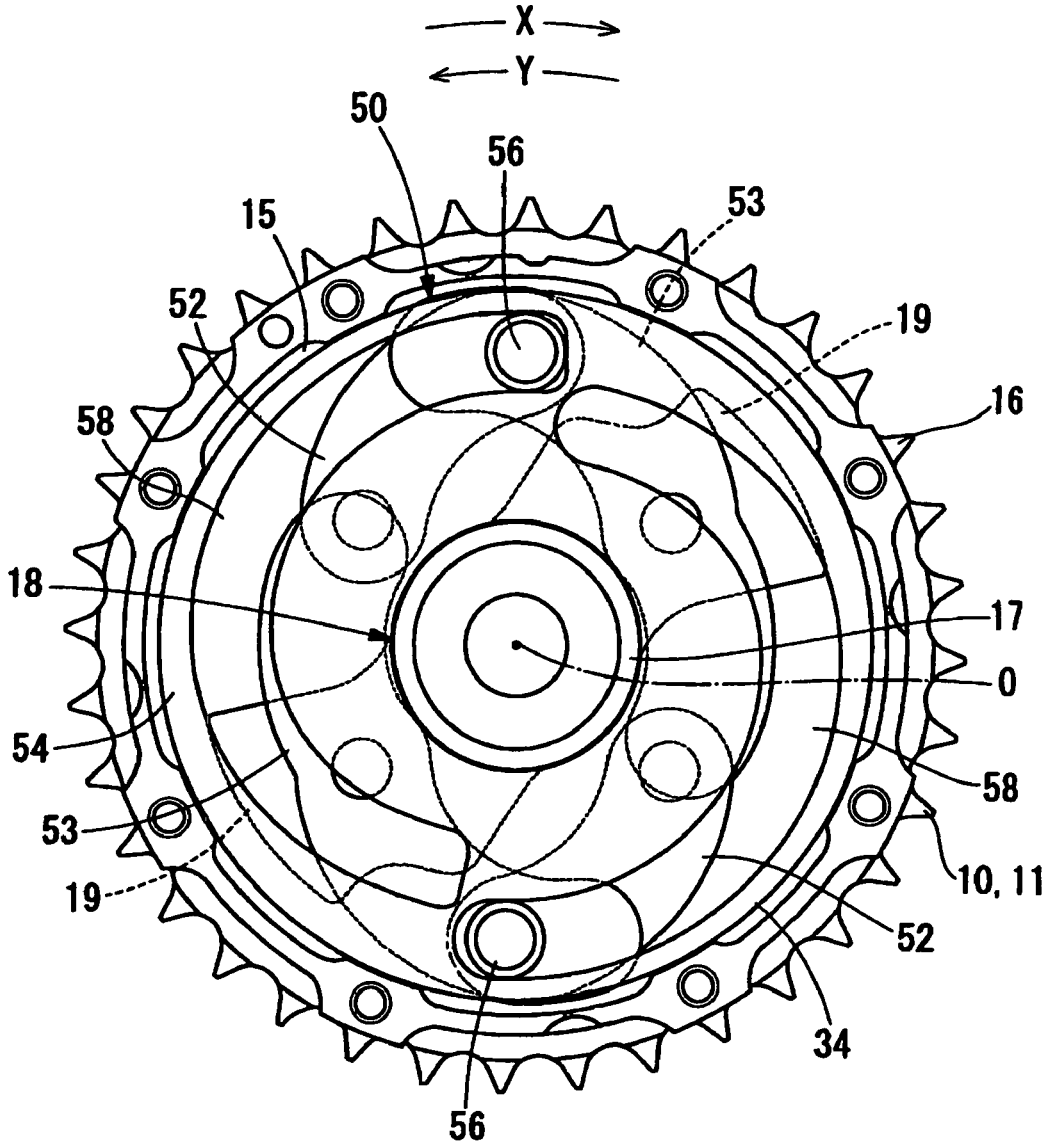
FIG. 4 is a cross sectional view taken along line IV-IV in FIG. 2.

As shown in FIGS. 2 to 4, the driving-side rotator 10 is formed as a hollow body and receives the speed reducer unit 30 and the link unit 50. The driving-side rotator 10 includes a stepped sprocket 11 and a stepped cover 12. A large diameter end portion of the sprocket 11 is coaxially fixed to a large diameter end portion of the cover 12 with screws. In the sprocket 11, a connecting portion 15, which connects between a large diameter portion 13 and a small diameter portion 14, has a plurality of teeth 16, which protrude radially outward. A timing chain is placed around the teeth 16 of the sprocket 11 and a plurality of teeth of the crankshaft. When the engine torque, which is outputted from the crankshaft, is transmitted to the sprocket 11 through a timing chain, the driving-side rotator 10 is synchronized with the crankshaft, so that the driving-side rotator 10 is rotated about a rotational center O while maintaining the relative rotational phase of the driving-side rotator 10 relative to the crankshaft. At this time, a rotational direction of the driving-side rotator 10 is a clockwise direction in each of FIGS. 3 and 4.

As shown in FIGS. 2 and 3, the driven-side rotator 18 includes a shaft 17 and two coupling portions 19. The shaft 17 is formed into a cylindrical body and is coaxial with the driving-side rotator 10. One end of the shaft 17 is fitted to an inner peripheral surface of the connecting portion 15 of the sprocket 11 in a rotatable manner and is coaxially fixed to one end of the camshaft 2 with a bolt. In this way, the driven-side rotator 18 is rotatable synchronously with the camshaft 2 about the rotational center O while maintaining a relative phase with respect to the camshaft 2. Also, the driven-side rotator 18 is rotatable relative to the driving-side rotator 10. One relative rotational direction of the driven-side rotator 18, which causes advance movement of the driven-side rotator 18, is a direction X and will be referred to as an advancing direction. The other relative rotational direction of the driven-side rotator 18, which causes retardation movement of the driven-side rotator 18, is a direction Y and will be referred to as a retarding direction.

Each coupling portion 19 is formed as a planar plate, which radially outwardly projects from an intermediate part of the shaft 17. Furthermore, the coupling portions 19 are displaced from each other by 180 degrees about the rotational center O.

Figure 5:
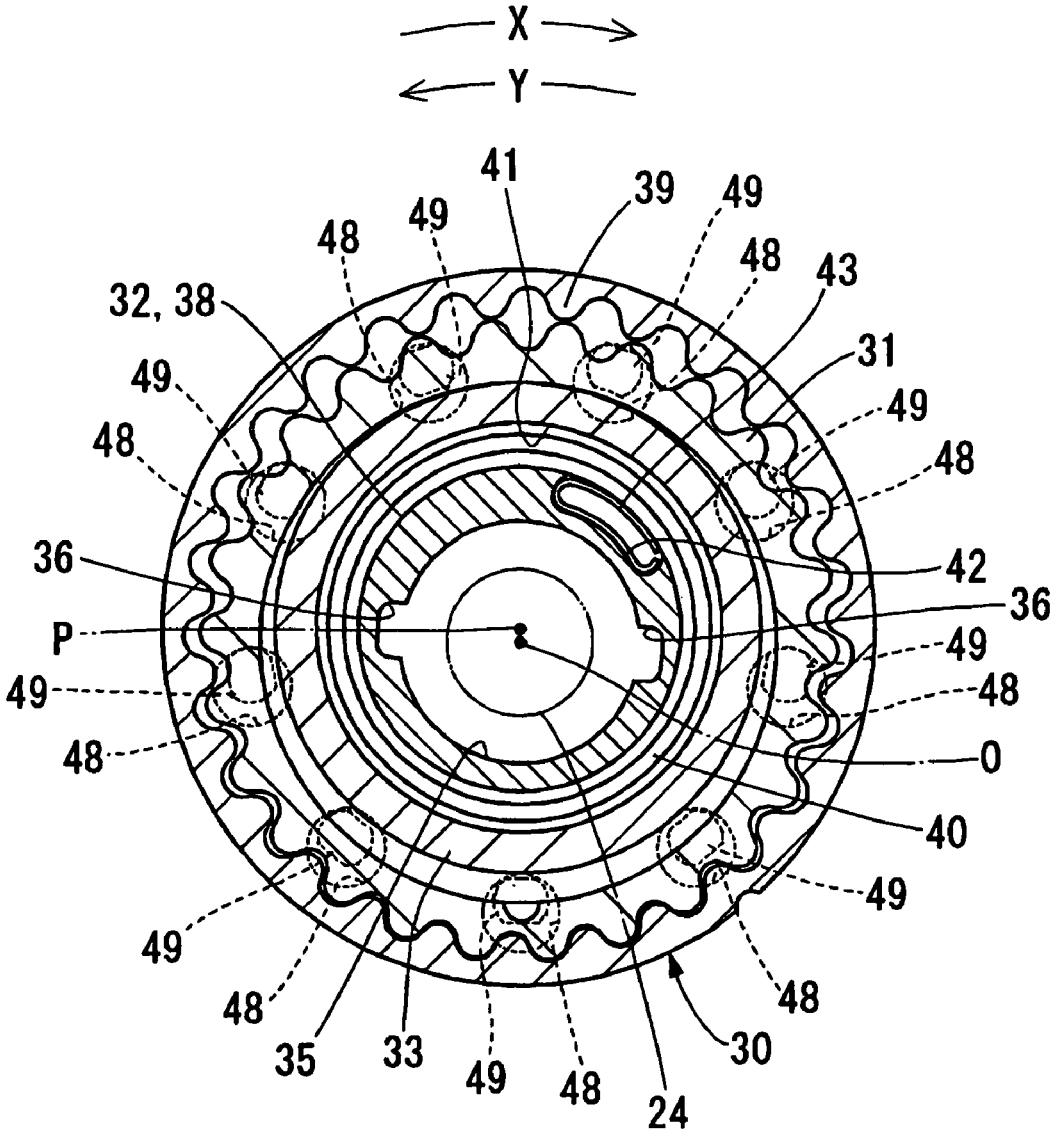
FIG. 5 is a cross sectional view taken along line V-V in FIG. 2.

With reference to FIGS. 2 and 5, the speed reducer unit 30 includes an external gear 31, a planetary carrier 32, an internal gear 33 and a guide rotator 34.

The external gear 31, which is a sun gear that has an addendum circle placed radially outward of a dedendum circle thereof, is riveted to the cover 12 in a coaxial manner and is integrally rotatable with the driving-side rotator 10. Thus, the external gear 31 is synchronized with the rotation of the crankshaft and is thereby rotated about the rotational center O while maintaining a relative phase with respect to the crankshaft.

The planetary carrier 32 is formed into a cylindrical body and includes an inner peripheral surface 35, which is a cylindrical surface that is coaxial with the driving-side rotator 10 and the motor shaft 24. A groove 36 is opened in an inner peripheral surface 35 of the planetary carrier 32. The motor shaft 24 is connected to the planetary carrier 32 through a coupling 37 that is fitted to the groove 36. In this way, the planetary carrier 32 is rotatable about the rotational center O and is rotatable relative to the driving-side rotator 10. The planetary carrier 32 has an eccentric portion 38. The eccentric portion 38 has a cylindrical peripheral surface that is eccentric to the rotational center O.

The internal gear 33, which is a planetary gear, is formed into a bottomed cylindrical body and includes a toothed portion 39, in which an addendum circle is placed radially inward of its dedendum circle. The dedendum circle of the toothed portion 39 is larger than the addendum circle of the external gear 31. Also, the number of teeth of the toothed portion 39 is greater than the number of teeth of the external gear 31 such that a difference between the number of teeth of the toothed portion 39 and the number of teeth of the external gear 31 is one. The toothed portion 39 is eccentric to the external gear 31 and is arranged radially outward of the external gear 31. Furthermore, the toothed portion 39 is meshed with the external gear 31 on a side that is opposite from an eccentric side thereof. The central hole 41 of the internal gear 33 is formed into a cylindrical hole, which is coaxial with the toothed portion 39. The eccentric portion 38 is fitted into the central hole 41 of the internal gear 33 through a bearing 40. In this way, the internal gear 33 is supported by the planetary carrier 32 in such a manner that the internal gear 33 rotates about a rotational center P of the eccentric portion 38 and at the same time revolves in the rotational direction of the eccentric portion 38 to implement the planetary movement. In the present embodiment, a U-shaped leaf spring 43 is received in a receiving hole 42, which is opened in the eccentric portion 38. When the leaf spring 43 pushes the central hole 41 of the internal gear 33 through the bearing 40, the internal gear 33 is effectively meshed with the external gear 31.

As shown in FIGS. 2 and 4, the guide rotator 34 is formed into an annular plate body, which is coaxial with the driving-side rotator 10. The guide rotator 34 is slidably fitted to an outer peripheral surface of an end portion of the shaft 17 of the driven-side rotator 18, which is opposite from the camshaft 2. In this way, the guide rotator 34 is rotatable about the rotational center O, and thereby the guide rotator 34 is rotatable relative to the rotators 10, 18. As shown in FIGS. 1, 2 and 5, the guide rotator 34 includes nine engaging holes 48, which are arranged one after another at equal intervals in the rotational direction. The internal gear 33 includes nine engaging projections 49, which are arranged one after another at equal intervals in a revolving direction of the internal gear 33 (the direction that coincides with a circumferential direction of the internal gear 33). The projections 49 are loosely engaged with the engaging holes 48, respectively, in a manner that allows transmission of the torque from the internal gear 33 to the guide rotator 34 while permitting the planetary movement of the internal gear 33.

In the above speed reducer unit 30, when the planetary carrier 32 does not rotate relative to the driving-side rotator 10, the internal gear 33 does not make the planetary movement and thereby rotates together with the driving-side rotator 10. Therefore, each projection 49 urges an inner peripheral wall of the corresponding engaging hole 48 in the rotational direction. As a result, the guide rotator 34 is rotated in the clockwise direction in FIG. 5 while maintaining the relative phase with respect to the driving-side rotator 10.

When the planetary carrier 32 is rotated relative to the driving-side rotator 10 in the direction X due to an increase in the motor torque in the direction X, the internal gear 33 makes the planetary movement while changing its meshed teeth, which are meshed with those of the external gear 31. Thus, an urging force (torque) of each projection 49, which urges the inner peripheral surface of the corresponding engaging hole 48 in the rotational direction, is increased. As a result, the guide rotator 34 rotates relative to the driving-side rotator 10 in the direction X. When the planetary carrier 32 is rotated relative to the driving-side rotator 10 in the direction Y due to an increase in the motor torque in the direction Y, the internal gear 33 makes the planetary movement while changing its meshed teeth, which are meshed with those of the internal gear 33. Thus, each projection 49 urges the inner peripheral surface of the corresponding engaging hole 48 in a counter-rotational direction, which is opposite from the above-described rotational direction. As a result, the guide rotator 34 rotates relative to the driving-side rotator 10 in the direction Y.

Through use of the above-described speed reducer unit 30, the motor torque can be amplified and transmitted to the guide rotator 34, so that the guide rotator 34 can be rotated relative to the driving-side rotator 10.

Figure 6:
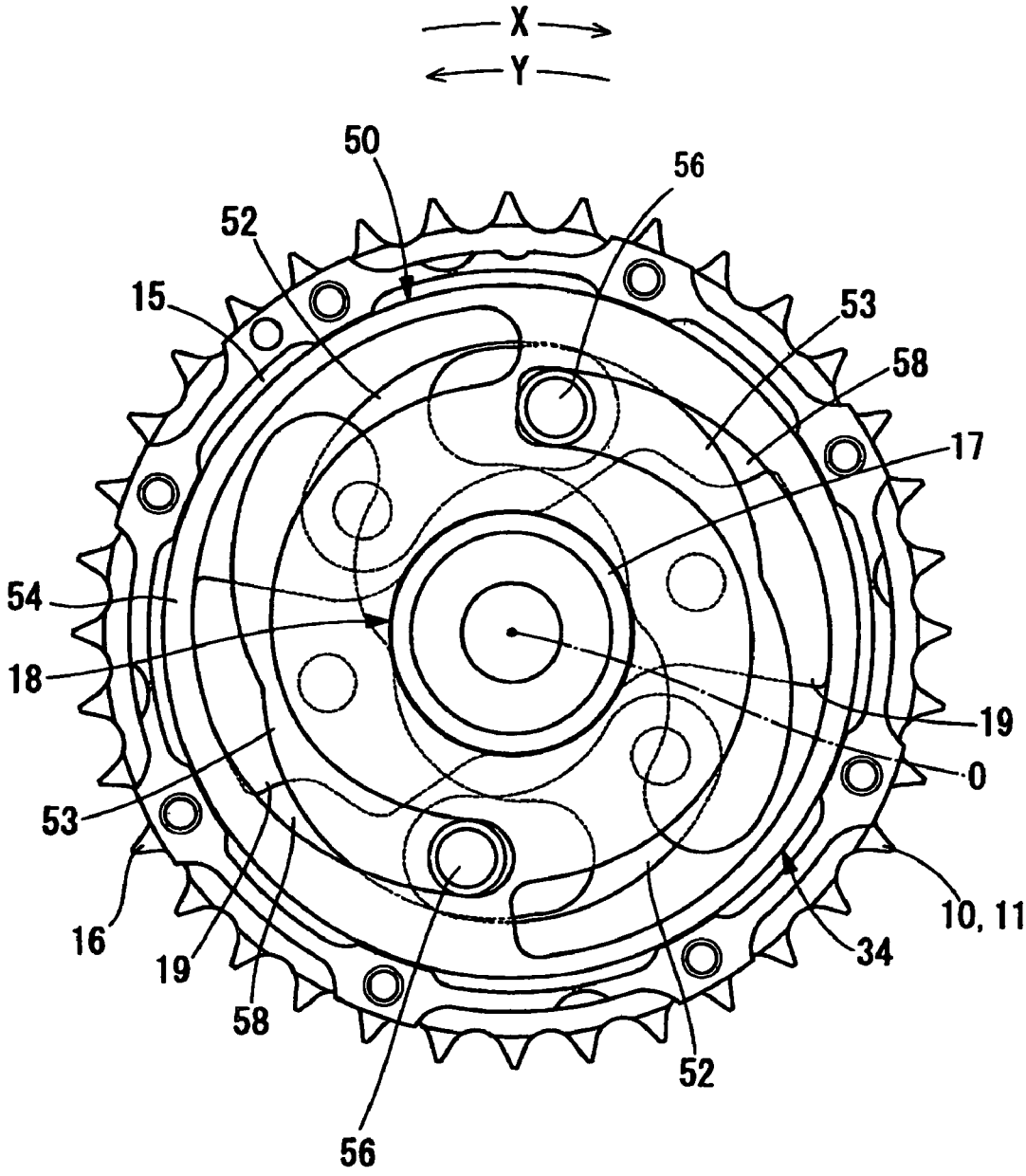
FIG. 6 is a cross sectional view similar to FIG. 4 but showing another operational state.

As shown in FIGS. 2 to 4 and 6, the link unit 50 includes two first type links 52, two second type links 53, a groove forming portion 54 and two movable bodies 56. FIGS. 2 to 4 show one state of the link unit 50, in which the driven-side rotator 18 is most retarded relative to the driving-side rotator 10. FIG. 6 shows another state of the link unit 50, in which the driven-side rotator 18 is most advanced relative to the driving-side rotator 10. In FIGS. 3, 4 and 6, respective hatchings, which indicate a corresponding cross sectional area, are omitted for the sake of simplicity.

As shown in FIGS. 2 and 3, each first type link 52 is formed into an arcuate plate body. Furthermore, the two first type links 52 are displaced from each other by 180 degrees about the rotational center O and are thereby symmetrical about the rotational center O. Also, the first type links 52 are coupled to predetermined part of the connecting portion 15 by means of a revolute pair. Each second type link 53 is formed as an ω (omega) shaped plate body. Furthermore, the two second type links 53 are displaced from each other by 180 degrees about the rotational center O and are thereby symmetrical about the rotational center O. Also, the second type links 53 are coupled to the coupling portions 19, respectively, by means of a revolute pair and are coupled to the first type links 52 by means of a revolute pair.

As shown in FIGS. 2 and 4, the groove forming portion 54 is formed in a part of the guide rotator 34 that includes an end surface of the guide rotator 34, which is opposite from the internal gear 33. In the groove forming portion 54, two guide grooves 58 are formed in such a manner that the guide grooves 58 are rotationally symmetric to each other about the rotational center O, i.e., are displaced from each other by 180 degrees about the rotational center O. Each guide groove 58 is curved and extends with a predetermined width on a radially outer side of the rotational center O in such a manner that the guide groove 58 is tilted relative to a radial direction of the guide rotator 34, and thereby a radial distance from the rotational center O to the guide groove 58 changes in an extending direction of the guide groove 58. Here, as shown in FIGS. 4 and 6, the guide groove 58 of the present embodiment is curved like a vortex line, which changes its curvature along its line, and the guide groove 58 is tilted such that a distance from the rotational center O to the guide groove 58 increases in the direction X. Alternatively, the guide groove 58 may be tilted such that the distance from the rotational center O to the guide groove 58 increases in the direction Y. Further alternatively, the groove 58 may have any other configuration, such as a straight linear configuration, other than the above curved configuration.

As shown in FIGS. 2 to 4, each movable body 56 is formed into a cylindrical shaft body and is eccentric to the rotational center O. One end portion of each movable body 56 is made of two cylindrical members and is slidably engaged with the corresponding guide groove 58. The other end portion of each movable body 56 is engaged with the corresponding first type link 52 in a rotatable manner with respect to the first type link 52. An intermediate portion of each movable body 56 is securely press fitted to the corresponding second type link 53. Through the above engagement and press fitting, each movable body 56 implements the revolute pair between the link 52 and the link 53.

In the above-described link unit 50, when the guide rotator 34 maintains its relative phase with respect to the driving-side rotator 10, each movable body 56 is not guided along the guide groove 58 and is rotated together with the guide rotator 34. At this time, the relative positional relationship between the coupled links 52, 53 does not change, so that the driven-side rotator 18 is rotated in the clockwise direction in FIGS. 4 and 6 while maintaining its relative phase with respect to the driving-side rotator 10. Thus, the engine phase is not changed, and the valve timing is maintained.

When the guide rotator 34 is rotated relative to the driving-side rotator 10 in the direction X, each movable body 56 is guided in the corresponding guide groove 58 toward the rotational center O. At this time, each movable body 56 is moved such that the movable body 56 rotates the corresponding first type link 52 and reduces a distance between the movable body 56 and the rotational center O. Therefore, each second type link 53 is pressed by the movable body 56 and is thereby driven together with the coupling portion 19 in the direction X, so that the driven-side rotator 18 is rotated relative to the driving-side rotator 10 in the direction X. As a result, the engine phase is changed on the advancing side of the camshaft 2, and thereby the valve timing is advanced. When the guide rotator 34 is rotated relative to the driving-side rotator 10 in the direction Y, each movable body 56 is guided in the corresponding guide groove 58 away from the rotational center O. At this time, each movable body 56 is moved such that the movable body 56 rotates the corresponding first type link 52 and increases the distance between the movable body 56 and the rotational center O. Therefore, each second type link 53 is pulled by the movable body 56 and is thereby driven together with the coupling portion 19 in the direction Y, so that the driven-side rotator 18 is rotated relative to the driving-side rotator 10 in the direction Y. As a result, the engine phase is changed on the retarding side of the camshaft 2, and thereby the valve timing is retarded.

With the above-described link unit 50, each movable body 56 and each link 52, 53 are driven in response to the relative rotation of the guide rotator 34 with respect to the driving-side rotator 10, and thereby the engine phase is changed, and the valve timing is adjusted.

Figure 7:
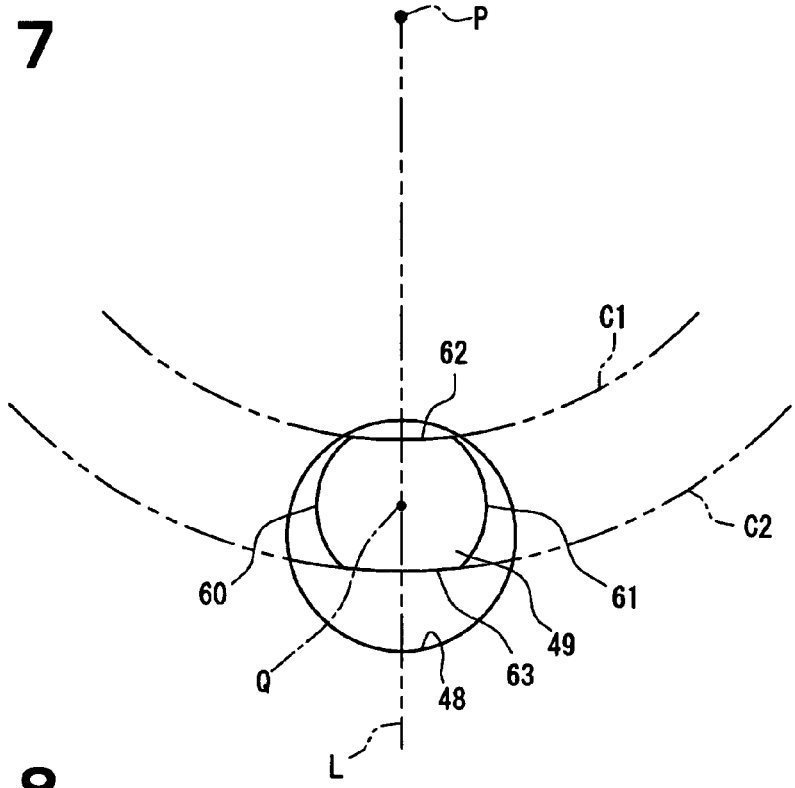
FIG. 7 is a schematic diagram for describing a characteristic structure according to the first embodiment.

Next, characteristics of the first embodiment will be described in detail. As shown in FIG. 1, according to the first embodiment, each engaging hole 48 has a cylindrical inner peripheral surface. In contrast to this, a cylindrical outer peripheral surface of each projection 49, which has a diameter smaller than that of the corresponding engaging hole 48, is truncated, i.e., cut off at a radially inner side and a radially outer side thereof along a radial line L of the internal gear 33, which passes through a radial center Q of the projection 49. Specifically, as shown in FIG. 7, each projection 49 includes two circumferential side surface sections 60, 61 and two reduced surface sections (alternatively referred to as truncated surface sections or cut-off surface sections) 62, 63. As will be described in detail with reference to FIG. 8 below, the reduced surface sections 62, 63 are formed by radially reducing a size of a circular cross section of the projection 49, which is centered at the center Q, along the radial line L. This reduction will leave the arcuate circumferential side surface sections 60, 61.

Therefore, the center Q of the projection 49 is a center Q of curvature of the circumferential side surface section 60, which coincides with a center Q of curvature of the circumferential side surface section 61. A radius of each circumferential side surface section 60, 61, which is measured from the center Q of curvature the circumferential side surface section 60, 61 is constant in a circumferential direction of the circumferential side surface section 60, 61. Furthermore, the circumferential side surface sections 60, 61 are opposed to each other about the radial line L of the internal gear 33 in the circumferential direction of the internal gear 33. In this way, the circumferential side surface sections 60, 61 are coaxial and have the same radius.

The reduced surface section 62 is an arcuate surface section that is curved along an imaginary circle Cl, which is coaxial with the internal gear 33. Furthermore, the reduced surface section 62 connects between a radially inner end of the circumferential side surface section 60 and a radially inner end of the circumferential side surface section 61, which are closer to a revolution center P (coinciding with the rotational center P) of the internal gear 33 in comparison to radially outer ends of the circumferential side surface sections 60, 61. Furthermore, the reduced surface section 63 is an arcuate surface section that is curved along an imaginary circle C2, which is coaxial with the inner gear 33 and has a radius of curvature larger than that of the imaginary circle C1. Furthermore, the reduced surface section 63 connects between the radially outer end of the circumferential side surface section 60 and the radially outer end of the circumferential side surface section 61, which are further from the revolution center P in comparison to the radially inner ends of the circumferential side surface sections 60, 61. With the above structure, at each of the reduced surface sections 62, 63, a distance from the center Q of curvature of each circumferential side surface section 60, 61 to the reduced surface section 62, 63 changes in the circumferential direction of the internal gear 33 in the plane of FIG. 7 and is smaller than the radius of curvature of each circumferential side surface section 60, 61 along an entire circumferential extent of the reduced surface section 62, 63.

Thus, according to the first embodiment, the outer peripheral surface of each projection 49 is truncated at the radially inner side and the radially outer side thereof to form the reduced surface sections 62, 63. Therefore, each projection 49 does not contact the inner peripheral surface of the corresponding engaging hole 48 at or around the radial line L. Thereby, the urging force of each projection 49, which urges the inner peripheral surface of the corresponding engaging hole 48 in the radial direction of the guide rotator 34, is effectively reduced to effectively limit the increase in the friction between the projection 49 and the inner peripheral surface of the engaging hole 48. As a result, the transmission efficiency of the torque from the internal gear 33 to the guide rotator 34 can be effectively increased.

Furthermore, according to the first embodiment, each circumferential side surface section 60, 61 of each projection 49 slides smoothly along the arcuate inner peripheral surface of the corresponding engaging hole 48. Thus, it is possible to limit the frictional sticking of the projection 49 against the inner peripheral surface of the engaging hole 48.

Figure 8:
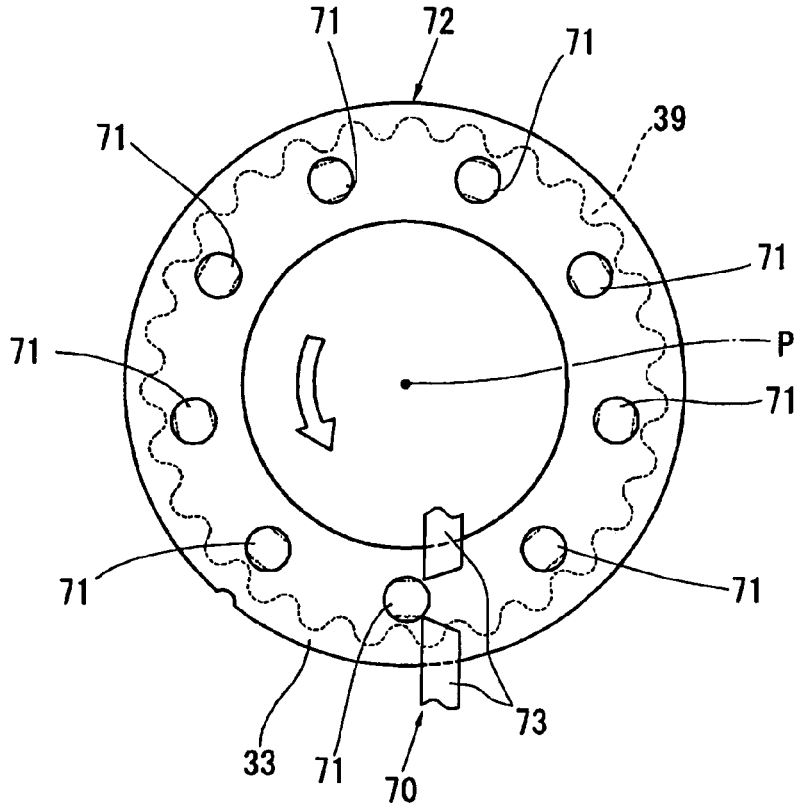
FIG. 8 is a schematic diagram for describing an exemplary manufacturing method according to the first embodiment.

Each projection 49 can be easily processed to form the reduced surface sections 62, 63 by using, for example, a lathe 70 shown in FIG. 8. Specifically, a semimanufactured product 72, in which cylindrical projections 71 project from the internal gear 33 and are arranged one after another in the circumferential direction of the internal gear 33, is rotated in the circumferential direction of the internal gear 33. While the semimanufactured product 72 is rotated, two single-point tools (cutting edges) 73 are urged against respective cylindrical projections 71 on radially inner and outer sides, respectively to cut the respective cylindrical projections 71. In this way, the outer peripheral surface of each cylindrical projection 71 is cut on both the radially inner and outer sides to simultaneously form the multiple projections 49, each of which has the circumferential side surface sections 60, 61 and the reduced surface sections 62, 63.

In the above-described first embodiment, the external gear 31 corresponds to a first gear of the invention, and the internal gear 33 corresponds to a second gear of the invention. Furthermore, the projections 49 correspond to projections of the invention, and the guide rotator 34 corresponds to a rotator of the invention.

Second Embodiment

A second embodiment will be described with reference to FIGS. 9 and 10. In the following description, components similar to those of the first embodiment will be indicated by the same numerals and will not be described further for the sake of simplicity.

Figure 9:
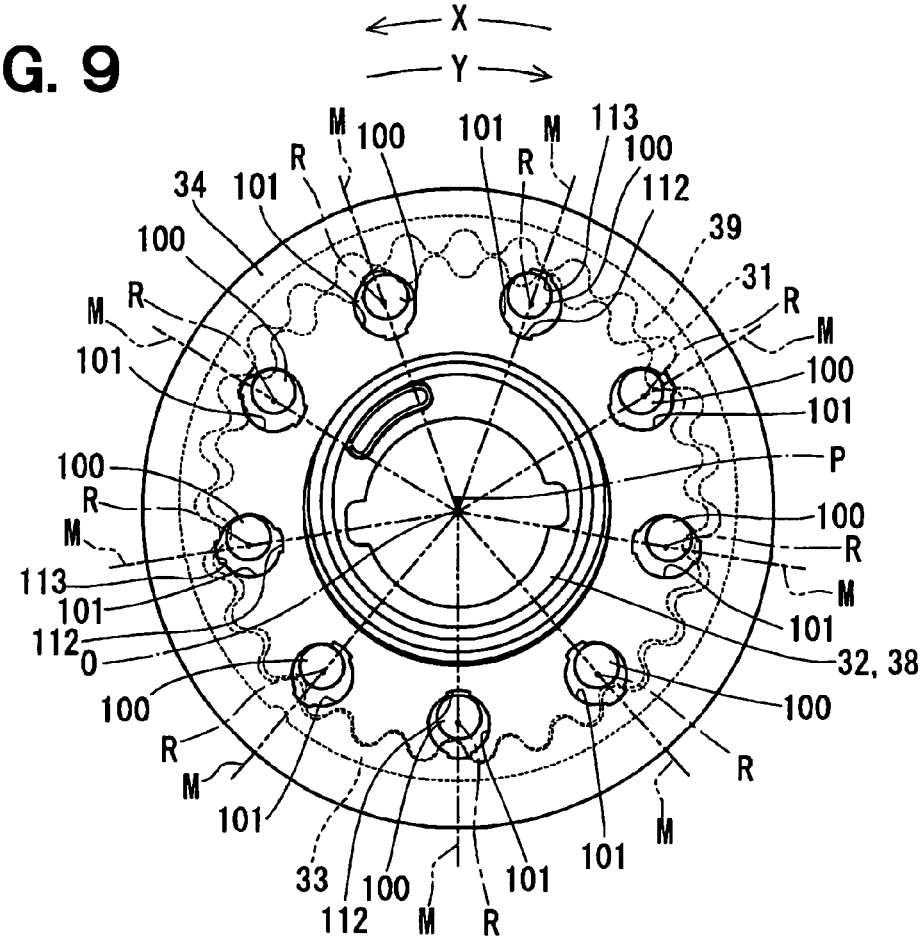
FIG. 9 is a cross sectional view similar to FIG. 1, showing a characteristic structure according to a second embodiment of the present invention.
Figure 10:
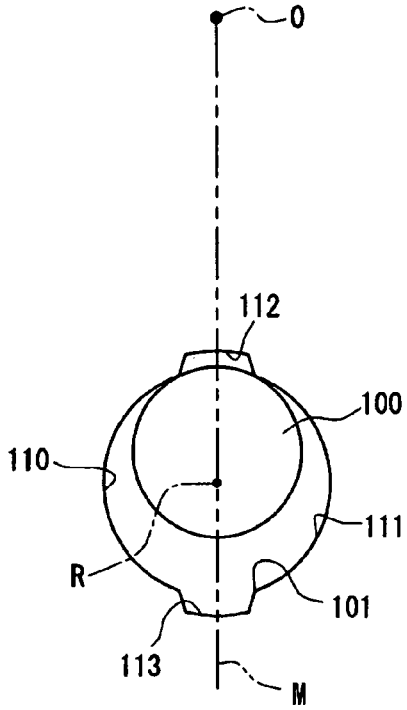
FIG. 10 is a schematic diagram for describing a characteristic structure according to the second embodiment.

As shown in FIG. 9, the second embodiment is a modification of the first embodiment. In the second embodiment, each of projections 100, which project from the internal gear 33, has a cylindrical outer peripheral surface. Each of engaging holes 101, which respectively receive the projections 100, has a cylindrical (arcuate) inner peripheral surface, which has a radius of curvature larger than that of the corresponding projection 100. Two recesses are formed in the cylindrical inner peripheral surface of each engaging hole 101 to radially oppose with each other along a radial line M of the guide rotator 34, which passes through a center R of the cylindrical inner peripheral surface of the engaging hole 101. Specifically, as shown in FIG. 10, each engaging hole 101 includes two circumferential side surface sections 110, 111 and two recessed surface sections 112, 113.

The center R of curvature of the circumferential side surface section 110 coincides with the center R of curvature of the circumferential side surface section 111, and a radius of each circumferential side surface section 110, 111, which is measured from the center R of curvature of the circumferential side surface section 110, 111, is constant in a circumferential direction of the circumferential side surface section 110, 111. Furthermore, the circumferential side surface sections 110, 111 are opposed to each other about the radial line M of the guide rotator 34 in the circumferential direction of the guide rotator 34. In this way, the circumferential side surface sections 110, 111 are coaxial and have the same radius.

At the recessed surface section 112, a distance from the center R of curvature of each circumferential side surface section 110, 111 to the recessed surface section 112 is larger than the radius of curvature of each circumferential side surface section 110, 111 along an entire circumferential extent of the recessed surface section 112. Furthermore, the recessed surface section 112 connects between a radially inner end of the circumferential side surface section 110 and a radially inner end of the circumferential side surface section 111, which are closer to the rotational center O in comparison to radially outer ends of the circumferential side surface sections 110, 111. The recessed surface section 113 has substantially the same configuration as that of the recessed surface section 112. Specifically, at the recessed surface section 113, a distance from the center R of curvature of each circumferential side surface section 110, 111 to the recessed surface section 113 is larger than the radius of curvature of each circumferential side surface section 110, 111 along an entire circumferential extent of the recessed surface section 113. Furthermore, the recessed surface section 113 connects between a radially outer end of the circumferential side surface section 110 and a radially outer end of the circumferential side surface section 111, which are further from the rotational center O in comparison to radially inner ends of the circumferential side surface sections 110, 111.

As discussed above, according to the second embodiment, the inner peripheral surface of each engaging hole 101 is radially inwardly and outwardly recessed in the radial direction M of the guide rotator 34 to form the recessed surface sections 112, 113. Therefore, each engaging hole 101 cannot contact the outer peripheral surface of the projection 100 at or around the radial line M. Thereby, the urging force of each projection 100, which urges the inner peripheral surface of the corresponding engaging hole 101 in the radial direction of the guide rotator 34, is effectively reduced to effectively limit the increase in the friction between the projection 100 and the inner peripheral surface of the engaging hole 101. As a result, the transmission efficiency of the torque from the internal gear 33 to the guide rotator 34 can be effectively increased.

Furthermore, according to the second embodiment, the circumferential side surface section 110, 111 smoothly slides along the cylindrical outer peripheral surface of the projection 100. Therefore, it is possible to limit the sticking of the projection 100 against the inner peripheral surface the engaging hole 101.

In the second embodiment, the projection 100 corresponds to the projection of the invention.

The present invention is not limited to the above embodiments, and the above embodiments may be modified in various ways without departing from the scope and spirit of the present invention.

For example, the number of projections 49, 100 and the number of the corresponding engaging holes 48, 101 are not limited to nine and may be set to any number other than nine depending on a specification of the apparatus. Furthermore, in place of the projections 49, 100, hollow projections, which are similar to the projections 49, 100 except presence of an internal hole therein, may be used.

Furthermore, in the case of the projections 49 described in the first embodiment, one of the two reduced surface sections 62, 63 may be eliminated to connect between the two circumferential side surface sections 60, 61 with a continuous arcuate surface that is continuous with the circumferential side surface sections 60, 61. Also, in the first embodiment, as long as the distance from the center Q of curvature of each circumferential side surface section 60, 61 to the reduced surface section 62, 63 is larger than the radius of curvature of each circumferential side surface section 60, 61 along the entire circumferential extent of the reduced surface section 62, 63, the configuration of each reduced surface section 62, 63 may be changed to any other suitable configuration, which is other than the arcuate surface. For example, the two reduced surface sections 62, 63 may be changed to two parallel planar surface sections.

Furthermore, in the case of the engaging holes 101 described in the second embodiment, one of the two recessed surface sections 112, 113 may be eliminated to connect between the two circumferential side surface sections 110, 111 with a continuous arcuate surface that is continuous with the circumferential side surface sections 110, 111. Also, in the second embodiment, as long as the distance from the center R of curvature of each circumferential side surface section 110, 111 to the recessed surface section 112, 113 is smaller than the radius of curvature of each circumferential side surface section 110, 111 along the entire circumferential extent of the recessed surface section 112, 113, the configuration of each recessed surface section 112, 113 may be changed to any other suitable configuration.

In addition, in place of the electric motor 21, a solenoid brake apparatus or a hydraulic motor may be used. Also, the link unit 50 may be eliminated, and the rotator 34, which has no guide groove 58, may be connected to or integrated with the driven-side rotator 18. In such a case, when the rotator 34 rotates relative to the driving-side rotator 10 in the direction X, the valve timing is advanced. In contrast, when the rotator 34 rotates relative to the driving-side rotator 10 in the direction Y, the valve timing is retarded.

Figure 11:
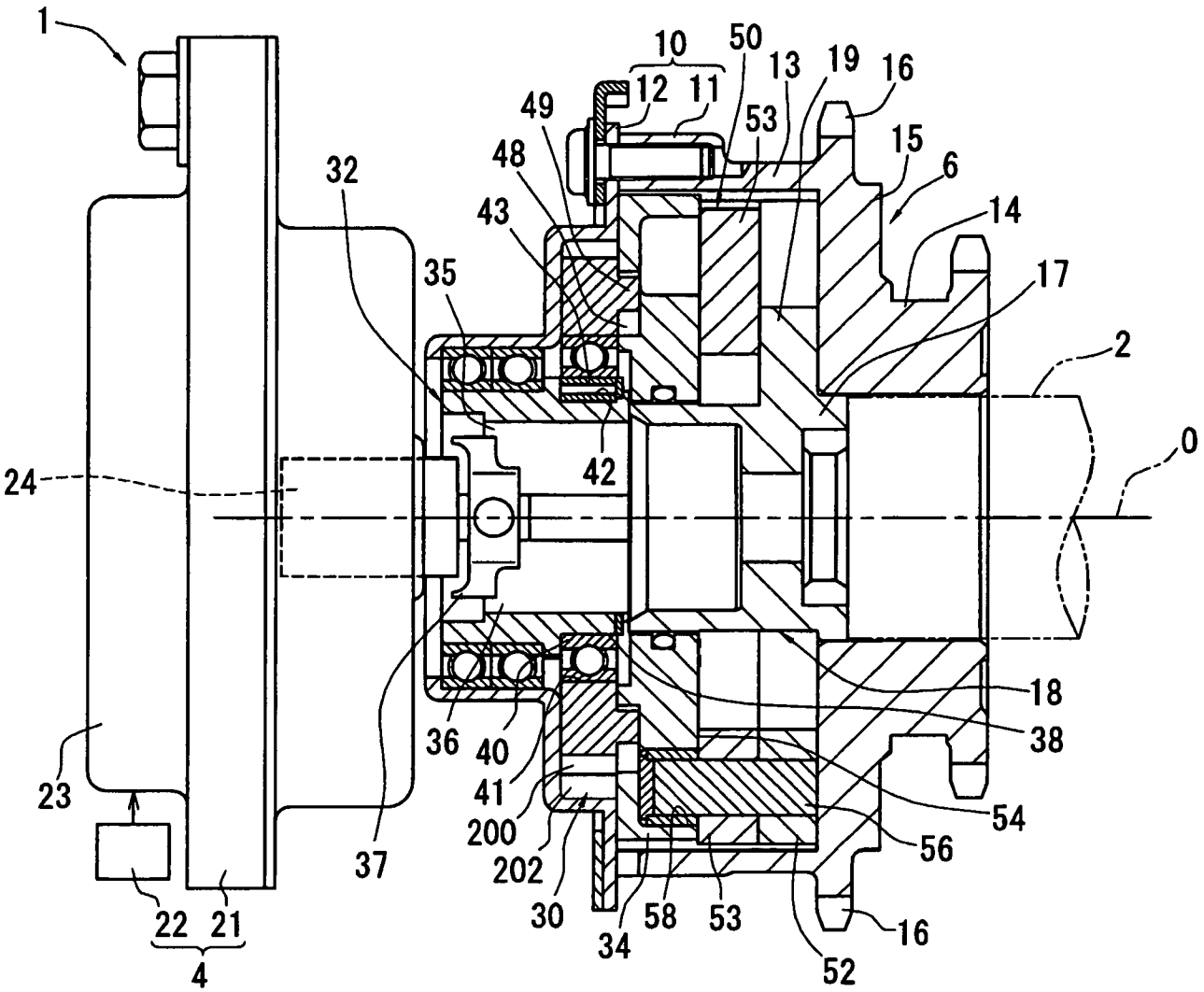
FIG. 11 is a cross sectional view showing a modification of the structure shown in FIG. 2.

In addition, the rotator 10 and the external gear 31 may be rotated synchronously with the camshaft 2, and the rotator 18 may be rotated synchronously with the crankshaft. Furthermore, as shown in FIG. 11, which indicates a modification of the first embodiment, an external gear 200, which includes the projections 49 (or 100) and is supported by the planetary carrier 32, may be provided in place of the internal gear 33, and an internal gear 202, which is meshed with the external gear 200, may be provided to the rotator 10 in place of the external gear 31. In such a case, the external gear 200 corresponds to the second gear of the invention, and the internal gear 202 corresponds to the first gear of the invention. The above structure of FIG. 11 is equally applicable to the second embodiment.

Furthermore, the present invention is not limited to the apparatus, which controls, i.e., adjusts the valve timing of the intake valve(s). For instance, the present invention may be equally implemented in an apparatus, which controls, i.e., adjusts valve timing of an exhaust valve(s). Also, the present invention may be implemented in an apparatus, which controls, i.e., adjusts both of the valve timing of the intake valve(s) and the valve timing of the exhaust valve(s).

Additional advantages and modifications will readily occur to those skilled in the art. The invention in its broader terms is therefore not limited to the specific details, representative apparatus, and illustrative examples shown and described.

What is claimed is:

1. A valve timing adjusting apparatus of an internal combustion engine, which controls valve timing of at least one of an intake valve and an exhaust valve that are opened and closed by a camshaft driven by a torque transmitted from a crankshaft at the engine, the valve timing adjusting apparatus comprising:

a first gear that is rotated synchronously with one of the crankshaft and the camshaft of the engine;

a second gear that is eccentric to the first gear and is meshed with the first gear to make a planetary movement, wherein the second gear includes a plurality of projections that are arranged one after another in a revolving direction of the second gear and axially project from the second gear; and a rotator that is coaxial with and is rotated relative to the first gear in response to the planetary movement of the second gear to change a relative phase between the crankshaft and the camshaft and thereby to change the valve timing of the at least one of the intake valve and the exhaust valve, wherein:

the rotator includes a plurality of engaging holes, which are arranged one after another in a rotational direction of the rotator and loosely receive the plurality of projections, respectively, in such a manner that each of the plurality of projections is engageable with an inner peripheral surface of a corresponding one of the plurality of engaging holes to transmit a torque between the second gear and the rotator; and an outer peripheral surface of each of the plurality of projections has at least one reduced surface section, which is radially inwardly reduced toward a radial center of the projection along a radial line of the second gear that passes through the radial center of the projection to have a reduced radial size in comparison to a radial size of the rest of the outer peripheral surface of the projection.

2. The valve timing adjusting apparatus according to claim 1, wherein the at least one reduced surface section includes two reduced surface sections, which are radially opposed to each other along the radial line of the second gear.

3. The valve timing adjusting apparatus according to claim 2, wherein:

the inner peripheral surface of each of the plurality of engaging holes is a cylindrical inner peripheral surface;

the outer peripheral surface of each of the plurality of projections includes two circumferential side surface sections, which are arranged on opposite sides, respectively, of the radial line of the second gear and are formed as two arcuate surface sections, respectively, that have a common center of curvature and a common radius of curvature;

the two reduced surface sections connect between the two circumferential side surface sections at radially inner ends and radially outer ends, respectively, of the two circumferential side surface sections; and a distance from the common center of curvature of the two circumferential side surface sections to each of the two reduced surface sections is smaller than the common radius of curvature of the two circumferential side surface sections.

4. The valve timing adjusting apparatus according to claim 3, wherein the two reduced surface sections are formed as two arcuate surface sections, respectively, which have a common center of curvature, which coincides with a rotational axis of the second gear.

5. The valve timing adjusting apparatus according to claim 1, further comprising an electric motor, which generates a rotational torque, wherein the second gear makes the planetary movement in response to the rotational torque generated from the electric motor.

6. A valve timing adjusting apparatus of an internal combustion engine, which controls valve timing of at least one of an intake valve and an exhaust valve that are opened and closed by a camshaft driven by a torque transmitted from a crankshaft at the engine, the valve timing adjusting apparatus comprising:

a first gear that is rotated synchronously with one of the crankshaft and the camshaft of the engine;

a second gear that is eccentric to the first gear and is meshed with the first gear to make a planetary movement, wherein the second gear includes a plurality of projections that are arranged one after another in a revolving direction of the second gear and axially project from the second gear; and a rotator that is coaxial with and is rotated relative to the first gear in response to the planetary movement of the second gear to change a relative phase between the crankshaft and the camshaft and thereby to change the valve timing of the at least one of the intake valve and the exhaust valve, wherein:

the rotator includes a plurality of engaging holes, which are arranged one after another in a rotational direction of the rotator and loosely receive the plurality of projections, respectively, in such a manner that each of the plurality of projections is engageable with an inner peripheral surface of a corresponding one of the plurality of engaging holes to transmit a torque between the second gear and the rotator; and the inner peripheral surface of each of the plurality of engaging holes has at least one recessed surface section, which is radially recessed from the rest of the inner peripheral surface of the engaging hole along a radial line of the rotator that passes through a center of the inner peripheral surface of the engaging hole.

7. The valve timing adjusting apparatus according to claim 6, wherein the at least one recessed surface section includes two recessed surface sections, which are radially opposed to each other along the radial line of the rotator.

8. The valve timing adjusting apparatus according to claim 7, wherein:

each of the plurality of projections has a cylindrical outer peripheral surface;

the inner peripheral surface of each of the plurality of engaging holes includes two circumferential side surface sections, which are arranged on opposite sides, respectively, of the radial line of the rotator and are formed as two arcuate surface sections, respectively, that have a common center of curvature and a common radius of curvature;

the two recessed surface sections connect between the two circumferential side surface sections at radially inner ends and radially outer ends, respectively, of the two circumferential side surface sections; and a distance from the common center of curvature of the two circumferential side surface sections to each of the two recessed surface sections is larger than the common radius of curvature of the two circumferential side surface sections.

9. The valve timing adjusting apparatus according to claim 6, further comprising an electric motor, which generates a rotational torque, wherein the second gear makes the planetary movement in response to the rotational torque generated from the electric motor.

* * * * *